US008547251B2

(12) United States Patent
Goudy et al.

(10) Patent No.: US 8,547,251 B2
(45) **Date of Patent: *Oct. 1, 2013**

(54) ON-BOARD VEHICLE WARNING SYSTEM AND VEHICLE DRIVER WARNING METHOD

(71) Applicants: Roy Goudy, Aichi (JP); Tetsuya Iijima, Tokyo (JP); Seiji Takeda, Fukui (JP)

(72) Inventors: Roy Goudy, Aichi (JP); Tetsuya Iijima, Tokyo (JP); Seiji Takeda, Fukui (JP)

(73) Assignee: Nissan North America, Inc., Franklin, TN (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/621,878

(22) Filed: Sep. 18, 2012

(65) Prior Publication Data

US 2013/0015983 A1 Jan. 17, 2013

Related U.S. Application Data

(63) Continuation of application No. 12/045,274, filed on Mar. 10, 2008, now Pat. No. 8,294,594.

(51) Int. Cl.
*G08G 1/09* (2006.01)

(52) U.S. Cl.
USPC ..... 340/905; 340/901

(58) Field of Classification Search
USPC ..... 340/901, 905, 988, 911, 913, 995.13, 340/929, 933; 364/463, 437, 438; 701/208, 701/414, 117, 25
See application file for complete search history.

(56) References Cited

U.S. PATENT DOCUMENTS

| | | | | |
|---|---|---|---|---|
| 4,908,616 | A * | 3/1990 | Walker | 340/929 |
| 5,257,194 | A * | 10/1993 | Sakita | 701/117 |
| 5,940,010 | A * | 8/1999 | Sasaki et al. | 340/901 |
| 6,516,273 | B1 | 2/2003 | Pierowicz et al. | |
| 6,700,504 | B1 * | 3/2004 | Aslandogan et al. | 340/901 |
| 6,720,889 | B2 * | 4/2004 | Yamaki et al. | 340/933 |
| 6,810,328 | B2 * | 10/2004 | Yokota et al. | 701/414 |
| 2008/0215202 | A1 * | 9/2008 | Breed | 701/25 |

* cited by examiner

*Primary Examiner* — Steven Lim
*Assistant Examiner* — Kaleria Knox
(74) *Attorney, Agent, or Firm* — Global IP Counselors, LLP

(57) ABSTRACT

An on-board vehicle warning system includes a location detecting section, a regulation retrieving section, an incoming message receiving section and a potential violation alerting section. The location detecting section detects respective geographic locations of a vehicle and a forthcoming intersection. The regulation retrieving section retrieves, based on the intersection location, a jurisdiction including local intersection regulation information pertaining to a vehicle position with respect to an intersection boundary at the time of a particular phase transition of a traffic light. The incoming message receiving section receives intersection status information of the intersection containing a geographic location of the boundary and phase information including a current phase and a time to the phase transition of a traffic light of the intersection. The potential violation alerting section estimates a future position of the vehicle with respect to the boundary at the occurrence of the phase transition to determine a potential violation.

20 Claims, 8 Drawing Sheets

| | JURISDICTION WHERE ENTRY ON YELLOW PERMITTED | JURISDICTION WHERE ENTRY ON YELLOW NOT PERMITTED | UNCERTAIN |
|---|---|---|---|
| MINIMUM GAP | $d_mingap_a$ | $d_mingap_b$ | $d_mingap_c$ |
| MARGIN | $d_margin_a$ | $d_margin_b$ | $d_margin_c$ |
| HYSTERESIS | $d_hys_a$ | $d_hys_b$ | $d_hys_c$ |

FIG. 7

ON-BOARD VEHICLE WARNING SYSTEM AND VEHICLE DRIVER WARNING METHOD

CROSS-REFERENCE TO RELATED APPLICATION

This application is a continuation of U.S. patent application Ser. No. 12/045,274, filed on Mar. 10, 2008, the entire contents of which are hereby incorporated herein by reference.

BACKGROUND OF THE INVENTION

1. Field of the Invention

The present invention generally relates to an on-board vehicle warning system and a vehicle driver warning method. More specifically, the present invention relates to an on-board vehicle warning system and a vehicle driver warning method for producing a driver notification based on a determination of a potential traffic violation by a host vehicle.

2. Background Information

Recently, vehicles are being equipped with a variety of informational systems such as navigation systems, Sirius and XM satellite radio systems, two-way satellite services, built-in cell phones, DVD players and the like. These systems are sometimes interconnected for increased functionality. Various informational systems have been proposed that use wireless communications between vehicles and between infrastructures, such as roadside units. These wireless communications have a wide range of applications ranging from crash avoidance to entertainment systems. The type of wireless communications to be used depends on the particular application. Some examples of wireless technologies that are currently available include digital cellular systems, Bluetooth systems, wireless LAN systems and dedicated short range communications (DSRC) systems.

Dedicated short range communications (DSRC) is an emerging technology that has been recently investigated for suitability in vehicles for a wide range of applications. DSRC technology will allow vehicles to communicate directly with other vehicles and with roadside units to exchange a wide range of information. In the United States, DSRC technology will use a high frequency radio transmission (5.9 GHz) that offers the potential to effectively support wireless data communications between vehicles, and between vehicles, roadside units and other infrastructure. The important feature of DSRC technology is that the latency time between communications is very low compared to most other technologies that are currently available. Another important feature of DSRC technology is the capability of conducting both point-to-point wireless communications and broadcast wireless messages in a limited broadcast area.

Accordingly, wireless technology can be used to provide various information from vehicle-to/from-infrastructure, and from vehicle-to-vehicle, such as providing GPS location, vehicle speed and other vehicle Parameter Identifiers (PIDs) including engine speed, engine run time, engine coolant temperature, barometric pressure, etc. The standard message set to be passed between vehicles, and between vehicles and the infrastructure using DSRC is covered by Society of Automotive Engineers (SAE) J2735-DSRC Message Set Dictionary. When communications are established between vehicles and/or roadside units in close proximity, this information would be communicated to provide a complete understanding of the vehicles in the broadcast area. This information then can be used by the vehicles for both vehicle safety applications and non-safety applications.

Recently, the Cooperative Intersection Collision Avoidance Systems (CICAS) initiative was launched to develop vehicle-infrastructure cooperative systems that address intersection crash problems related to stop sign violations, traffic signal violations, etc. One of the programs included in the CICAS initiative is the violation warning system (CICAS-Violation) that warns the driver via an in-vehicle device when it appears likely that the driver will violate a traffic signal or stop sign. More specifically, with the violation warning system, the roadside unit coupled to the traffic light device at the intersection sends intersection information including, signal presence, signal state (phase), and intersection map, etc. to the on-board equipment mounted on the vehicle. Then, the on-board equipment uses the intersection information and vehicle information to provide the driver of the vehicle with a timely warning of a potential traffic control violation (e.g., running a red light).

In view of the above, it will be apparent to those skilled in the art from this disclosure that there exists a need for an improved on-board vehicle warning system and vehicle driver warning method. This invention addresses this need in the art as well as other needs, which will become apparent to those skilled in the art from this disclosure.

SUMMARY OF THE INVENTION

The traffic laws and regulations vary from jurisdiction to jurisdiction. For example, although failing to stop for a red light is usually a legal offence in most jurisdictions, the definition of what constitutes the red-light running violation may be different from jurisdiction to jurisdiction. Under the traffic regulations of some jurisdiction, no offence has been committed as long as the light is yellow when the vehicle enters the intersection, while, under the traffic regulations of other jurisdictions, an offence occurs if the light turns red at any time before the vehicle clears the intersection. Also, some jurisdictions may have a stricter standard in which running a yellow light is an offence unless the vehicle is unable to stop safely. Thus, generally speaking, there are two approaches to traffic regulations pertaining traffic signals. Some jurisdictions allow vehicles to enter intersections on a yellow light while other jurisdictions permit vehicles to enter intersections only on a green light. In the latter case, warnings and advisories would need to be issued earlier as compared to the former case. However, the conventional traffic signal violation warning systems do not take into account those differences in the traffic regulations among different jurisdictions. Thus, with a single set of parameters tuned to the case where vehicles are only permitted in the intersection on a green light, warnings and advisories may be issued prematurely in jurisdictions where vehicles are allowed in the intersection on a yellow light. In these cases, the warning and advisories could be considered a nuisance to the driver.

Therefore, one object of the present invention is to provide an on-board vehicle warning system and a vehicle driver warning method that can properly warn the driver of the potential traffic light violation according to the local traffic regulation corresponding to the current location of the vehicle.

In order to achieve the above identified object, an on-board vehicle warning system includes a location detecting section, a regulation retrieving section, an incoming message receiving section and a potential violation alerting section. The location detecting section is configured to detect a geographic location of a host vehicle equipped with the on-board vehicle warning system, and a geographic location of a forthcoming intersection. The regulation retrieving section is configured to retrieve a jurisdiction based on the geographic location of the forthcoming intersection. The jurisdiction includes local intersection regulation information containing information pertaining to a vehicle position with respect to an intersection boundary at the time of a particular phase transition of a traffic light device. The incoming message receiving section is configured to receive intersection status information of the forthcoming intersection containing a geographic location of a boundary of the forthcoming intersection and phase information including a current phase and a time to the particular phase transition of a traffic light device of the forthcoming intersection. The potential violation alerting section is configured to estimate a future position at which the host vehicle will be with respect to the boundary of the forthcoming intersection at the time that the particular phase transition is going to occur to determine a potential violation.

These and other objects, features, aspects and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure:

FIG. 7 is a table showing an example for storing various advisory/warning parameters according to various traffic regulations in accordance with the illustrated embodiment of the present invention;

DETAILED DESCRIPTION OF THE PREFERRED EMBODIMENTS

Selected embodiment of the present invention will now be explained with reference to the drawings. It will be apparent to those skilled in the art from this disclosure that the following description of the embodiment of the present invention is provided for illustration only and not for the purpose of limiting the invention as defined by the appended claims and their equivalents.

Figure 1:
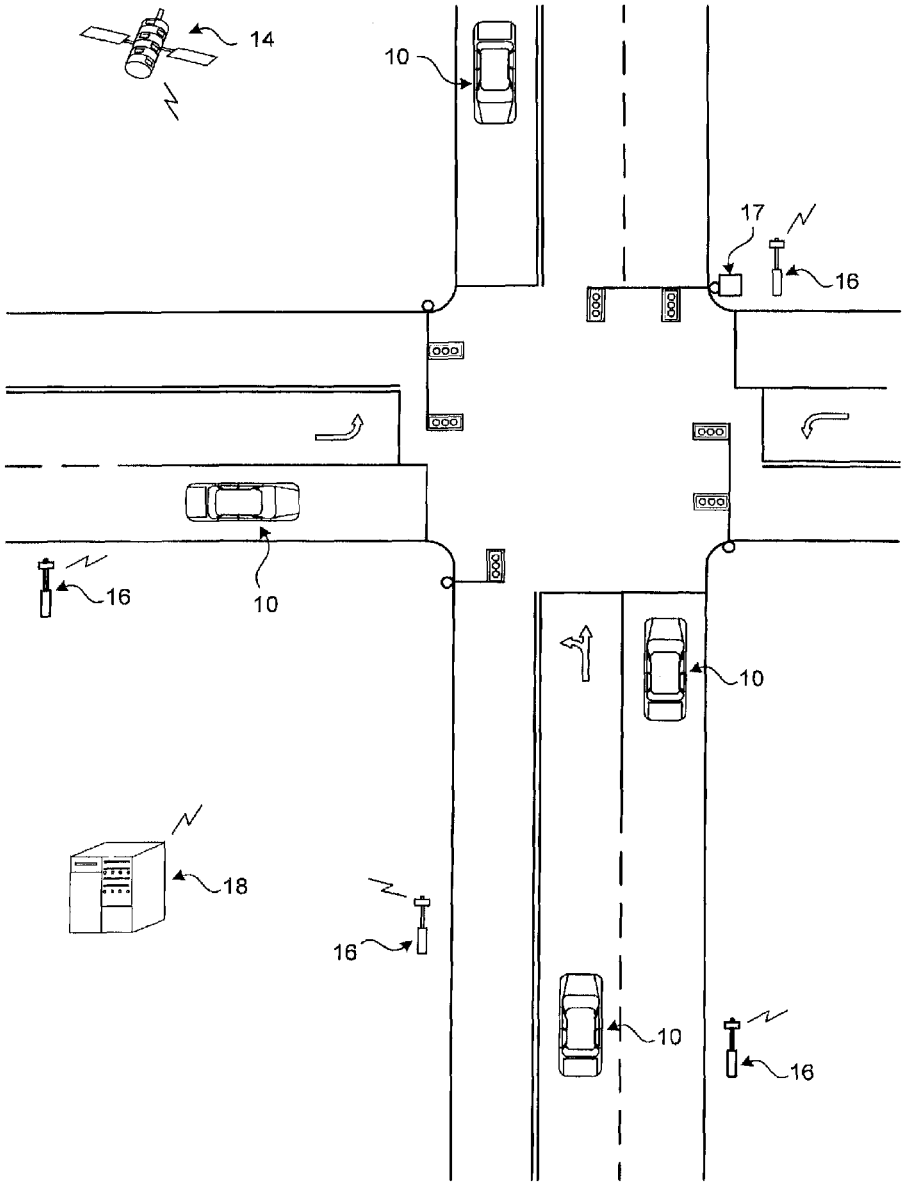
FIG. 1 is a pictorial representation of a wireless communications network showing several vehicles equipped with an on-board unit capable of conducting wireless communications with each other and as well as an external server via a plurality of roadside units in a vehicle infrastructure system in accordance with one embodiment of the present invention.

Referring initially to FIG. 1, a wireless communications network is illustrated that forms a part of a vehicle infrastructure system in accordance with one embodiment of the present invention. In this vehicle infrastructure system, at least one of a plurality of vehicles 10 is equipped with an on-board vehicle warning system 12 in accordance with one embodiment of the present invention. The wireless communications network also preferably includes one or more global positioning satellites 14 (only one shown), and one or more roadside units 16 and a base station or external server 18. The roadside units 16 are configured to relay signals between the on-board vehicle warning system 12 of the host vehicle 10 and the external server 18. Thus, the roadside units 16 are configured to send signals to the external server 18 and the on-board vehicle warning system 12 of the host vehicle 10, and receive signals from the on-board vehicle warning system 12 of the host vehicle 10 and the external server 18. Moreover, as shown in FIG. 1, an intersection unit 17 is provided in each of the traffic intersections for producing intersection information relating to the corresponding intersection. The intersection unit 17 is operatively coupled to the roadside unit 16 so that the traffic intersection information is communicated between the intersection unit 17 and the on-board vehicle warning system 12 of the host vehicle 10 via the roadside unit 16 when the host vehicle 10 enters within the broadcast range of the roadside unit 16. As explained in more detail below, the on-board vehicle warning system 12 is configured and arranged to determine a potential traffic violation by the host vehicle 10 with respect to a traffic control device (e.g., a traffic light device) in front of the host vehicle 10 according to the local traffic regulation corresponding to the current location of the host vehicle 10. Then, the on-board vehicle warning system 12 is configured to produce a driver notification to a driver of the host vehicle 10 based upon a determination of the potential traffic violation. In this system, the term "host vehicle" refers to a vehicle equipped with the wireless communications system with which the traffic intersection information is received from the intersection unit 17 via the roadside unit 16 in accordance with the illustrated embodiment.

Figure 2:
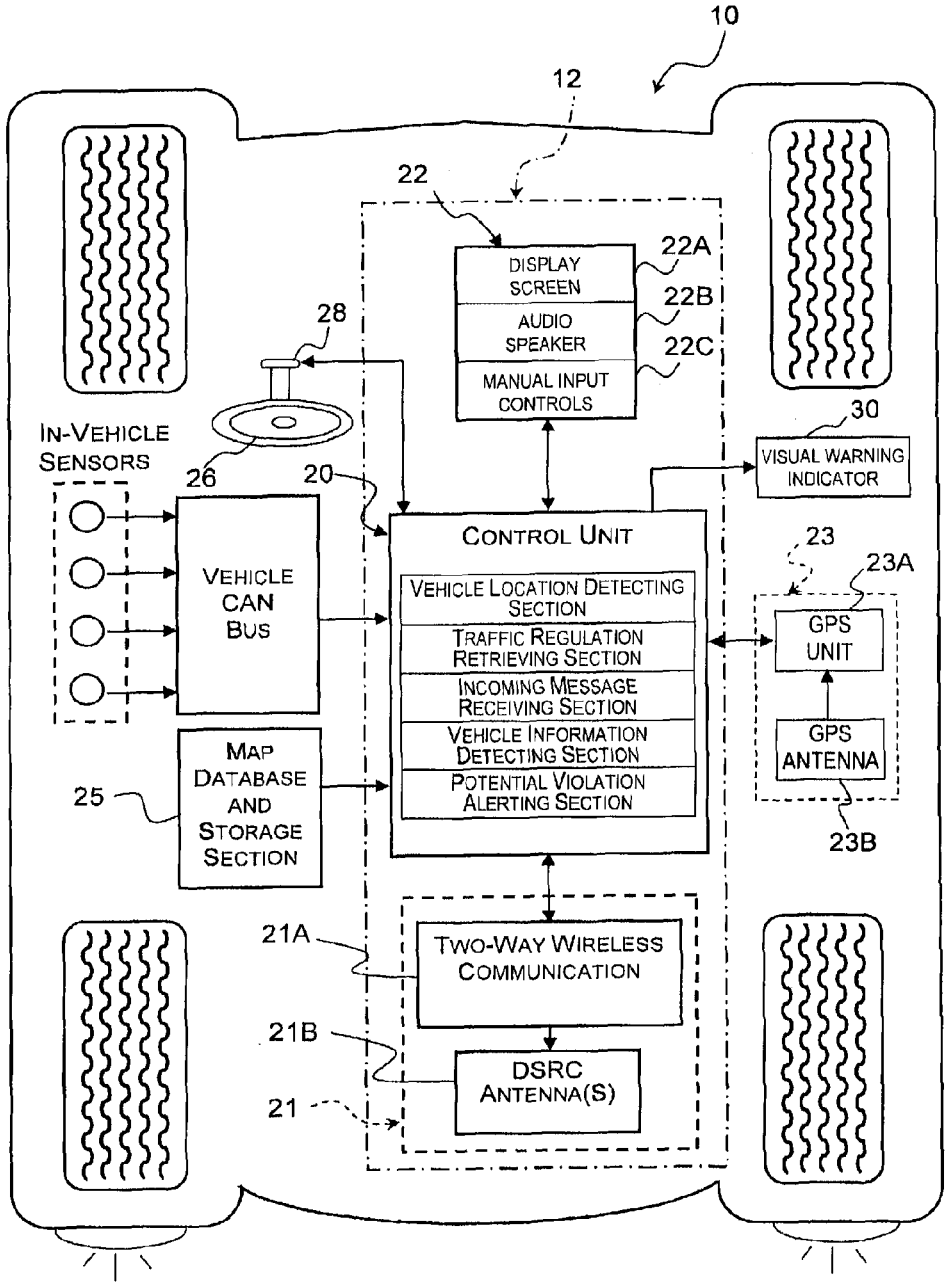
FIG. 2 is a schematic representation of a vehicle that is equipped with the on-board vehicle warning system in accordance with the illustrated embodiment of the present invention.

Referring now to FIG. 2, the on-board vehicle warning system 12 basically includes a controller or control unit 20, a wireless communication system 21 and a human-machine interface section 22. The control unit 20 and the human-machine interface section 22 cooperate together to constitute a driver alerting component that is configured to issue a driver notification (e.g., an advisory and/or a warning) regarding the potential traffic violation by the host vehicle 10. Also, the control unit 20 and the wireless communication system 21 cooperate together to constitute an incoming message receiving component that is configured to receive the intersection information from the intersection unit 17 via the roadside unit 16.

Figure 4:
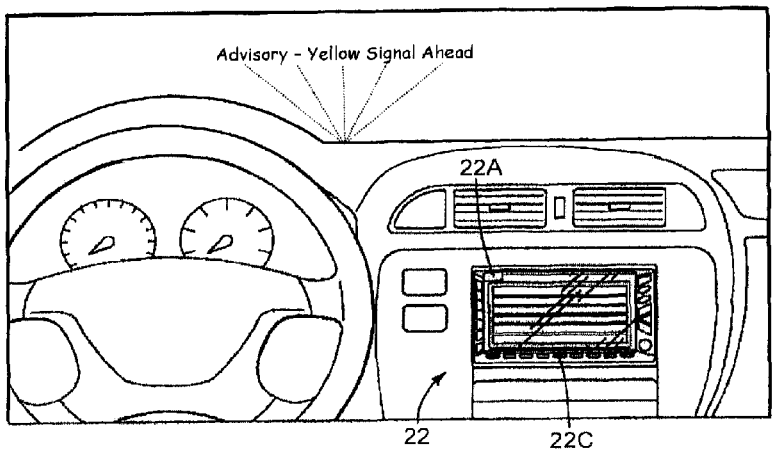
FIG. 4 is an inside elevational view of a portion of the vehicle's interior that is equipped with the on-board vehicle warning system in accordance with the illustrated embodiment of the present invention.

The wireless communication system 21 is configured and arranged such that the control unit 20 receives and/or sends various signals to other DSRC equipped component and systems in the communication (broadcasting/receiving) area that surrounds the host vehicle 10. The human-machine interface section 22 includes a screen display 22A (see FIG. 4), an audio speaker 22B and a plurality of manual input controls 22C (see FIG. 4) that are operatively coupled to the control unit 20. The control unit 20 is also preferably coupled to a global positioning system 23 having a GPS unit 23A and a GPS antenna 23B. The control unit 20 and the global positioning system 23 cooperate together to constitute a vehicle location detecting component that is configured to detect a current location of the host vehicle 10. A map database and storage section 25 (an on-board storage device) is also preferably provided that contains various data used by the control unit 20 to carry out the navigation controls as well as implementation of various safety measures including the potential traffic violation determination process. More specifically, in the illustrated embodiment, the map database and storage section 25 preferably stores traffic regulation data including information indicative of different traffic regulations relating to a plurality of jurisdictions (e.g., the traffic regulations of all States in the United States). The map database and storage section 25 can be manually updated through removable media (CD-ROM or DVD) or automatically updated via periodic communications with the external server 18. The control unit 20, the human-machine interface section 22, the global positioning system 23 and the map database and storage section 25 are operatively connected together to perform the various navigation functions, and thus, preferably constitute an on-board navigation unit. The navigation functions controlled by the control unit 20 are conventional, and thus, the navigation functions of the control unit 20 will not be discussed herein. Alternatively, the external server 18 can be used to communicate with the on-board vehicle warning system 12 to provide the off-board navigation service (dynamic navigation system) through wireless communications via the roadside units 16 within the wireless communications network, if need and/or desired.

Moreover, the control unit 20 of the on-board vehicle warning system 12 is configured to receive detection signals via the vehicle CAN bus from various in-vehicle sensors including, but not limited to, an ignition switch sensor, an accessory switch sensor, a vehicle speed sensor, an acceleration sensor, a throttle position sensor, a brake switch sensor, etc.

Still referring to FIG. 2, the vehicle 10 is basically a conventional vehicle which has been modified to incorporate the on-board vehicle warning system 12. Thus, the conventional parts of the vehicle 10 will not be discussed and/or illustrated herein. Rather, only those parts that interact with and/or related to the on-board vehicle warning system 12 will be discussed and/or illustrated herein as needed to understand the illustrated embodiment. The vehicle 10 is provided with a steering structure 26, a steering vibrating device 28, and a visual warning indicator 30 as well as other parts not shown. The steering vibrating device 28 is operatively controlled by the control unit 20 to vibrate the steering wheel of the steering structure 26 when the control unit 20 determines that it is desirable to warn the driver of a safety concern such as a potential traffic light violation. The visual warning indicator 30 is operatively controlled by the control unit 20 to provide a visual warning to the driver when a signal is received indicating a safety concern such as the potential traffic light violation.

The control unit 20 is operatively connected to the wireless communication system 21, the human-machine interface section 22, the global positioning system 23, the map database and storage section 25, the steering vibrating device 28, and the visual warning indicator 30. The control programs of the control unit 20 is programmed to include functions that can be generally divided into a vehicle location detecting section, a traffic regulation retrieving section, a incoming message receiving section, a vehicle information detecting section, and a potential violation alerting section.

The vehicle location detecting section of the control unit 20 is configured to detect a current location of the host vehicle 10 based on the information received from the global positioning system 23.

The traffic regulation retrieving section of the control unit 20 is configured to retrieve information relating to a local traffic regulation that is in effect in the current location of the host vehicle 10 detected by the vehicle location detecting section. More specifically, the traffic regulation retrieving section is preferably configured to read the information relating to the local traffic regulation from the map database and storage section 25. As mentioned above, the map database and storage section 25 stores the traffic regulation data including the traffic regulations relating to different jurisdictions. Alternatively, the traffic regulation retrieving section of the control unit 20 can be configured to wirelessly download the information relating to the local traffic regulation corresponding to the current location of the host vehicle 10 from an external server (e.g., the external server 18) that stores the traffic regulation data of different jurisdictions via the Internet link or the like.

The incoming message receiving section of the control unit 20 is configured to receive the intersection information of the upcoming traffic intersection from the intersection unit 17 via the roadside unit 16 when the host vehicle 10 enters within the broadcast range of the roadside unit 16.

The vehicle information detecting section of the control unit 20 is configured to detect vehicle travel information of the host vehicle 10. More specifically, the vehicle information detecting section is configured to process the various signals relating to the current traveling condition of the host vehicle 10 received from the in-vehicle sensors and other components (e.g., the global positioning system 23) operatively connected to the control unit 20. For example, the vehicle information detected by the vehicle information detecting section includes the vehicle acceleration/deceleration, the current speed, the position of the host vehicle 10 with respect to the upcoming intersection, and the like.

The potential violation alerting section of the control unit 20 is configured to determine whether the host vehicle 10 is likely to commit a traffic violation with respect to the upcoming intersection based on the intersection information received by the incoming message receiving section and the vehicle travel information detected by the vehicle travel information detecting section. Moreover, the potential violation alerting section is further configured to produce a driver notification (the advisory and/or the warning) to the driver of the host vehicle 10 based upon a determination of the potential traffic violation according to the local traffic regulation corresponding to the location of the host vehicle. More specifically, the potential violation alerting section is configured to adjust a parameter indicative of a distance between the traffic intersection and the position of the host vehicle at which the driver notification is produced according to the local traffic regulation corresponding to the location of the host vehicle.

The potential violation alerting section is further configured to produce the driver notification by using the human-machine interface section 22, the steering structure 26 and/or the visual warning indicator 30. For example, in the illustrated embodiment, the potential violation alerting section of the control unit 20 is preferably configured to produce the driver notification using the visual warning indicator 30 to project a visual advisory signal or a visual warning signal on the windshield (see FIG. 4) of the host vehicle 10 as part of the driver notification. Also, in the illustrated embodiment, the potential violation alerting section of the control unit 20 is preferably further configured to produce an audible signal using the audio speaker 22B as part of the driver notification in addition to the visual signal produced by the visual warning indicator 30. Alternatively, a haptic warning signal can be used in addition to or instead of the visual signal and the audible signal to alert the driver of the potential traffic violation. For example, the steering vibrating device 28 can vibrate the steering wheel of the steering structure 26 when the control unit 20 determines that it is desirable to warn the driver of the potential traffic violation as part of the driver notification. In other words, any combination of visual signals, auditory signals and haptic signals can be used to produce the driver notification to alert the driver of the potential traffic violation.

The control unit 20 preferably includes a microcomputer with a potential traffic violation determining program and a driver warning program. The control unit 20 also preferably includes other conventional sections such as an input interface circuit, an output interface circuit, and storage devices such as a ROM (Read Only Memory) device and a RAM (Random Access Memory) device. The memory circuit stores processing results and control programs such as ones for operation of the wireless communication system 21, the human-machine interface section 22, the global positioning system 23, the map database and storage section 25, the steering vibrating device 28 and the visual warning indicator 30. The control unit 20 is capable of selectively controlling other DSRC sections of the host vehicle 10 such as other safety systems as needed and/or desired. It will be apparent to those skilled in the art from this disclosure that the precise structure and algorithms for the control unit 20 can be any combination of hardware and software that will carry out the functions of the present invention.

The wireless communication system 21 preferably includes communication interface circuitry that connects and exchanges information with the roadside units 16 through a wireless network within the broadcast range of the host vehicle 10. The wireless communication system 21 is preferably configured and arranged to conduct direct two-way communications between the host vehicle 10 and the roadside units 16 (roadside-to-vehicle communications). Moreover, the wireless communication system 21 can also be configured and arranged to conduct direct two-way communications with other vehicles that are similarly equipped with the wireless communication system 21 (vehicle-to-vehicle communications).

More specifically, as seen in FIG. 2, the wireless communication system 21 is an on-board unit that includes a two-way communication device 21A and one or more antennas 21B. The wireless communication system 21 can be any suitable wireless system, e.g., DSRC cellular, Wimax, Wifi, etc. In other words, while the wireless communications network is illustrated as a dedicated short range communications (DSRC) network in this embodiment, it will be apparent to those skilled in the art from this disclosure that other types of wireless communications networks such as cellular, Wimax, Wifi, etc can be used as a wireless communications network to carry out the present invention. The two-way communication device 21A is configured to at least conduct direct short range communications in a host vehicle broadcast area surrounding the host vehicle 10 via the antennas 21B. Preferably, the antennas 21B include both an omni-directional antenna and a multi-directional antenna. In one preferred embodiment, the wireless communication system 21 is a dedicated short range communication (DSRC) system, since the latency time between communications is very low compared to most other technologies that are currently available. However, other wireless communication systems can be used if they are capable of conducting both point-to-point wireless communications and broadcast wireless messages in a limited broadcast area so long as the latency time between communications is short enough to carry out the present invention. When the wireless communication system 21 is a DSRC system, the wireless communication system 21 will transmit at a 75 Mhz spectrum in a 5.9 GHz band with a data rate of 1 to 27 Mbps, and a maximum range of about 1,000 meters. The wireless communication system 21 will be assigned a Medium Access Control (MAC) address and/or an IP address so that each vehicle in the network can be individually identified.

The global positioning system 23 is a conventional global positioning system (GPS) that is configured and arranged to receive global positioning information of the host vehicle 10 in a conventional manner. Basically, the GPS unit 23A is a receiver for receiving a signal from the global positioning satellite 14 (FIG. 1) via the GPS antenna 23B. The signal transmitted from the global positioning satellite 14 is received at regular intervals (e.g. one second) to detect the present position of the host vehicle 10. The GPS unit 23A preferably has an accuracy of indicting the actual vehicle position within a few meters or less. This data (present position of the host vehicle) is fed to the control unit 20 for processing. Moreover, the GPS data is also transmitted to the roadside units 16 through wireless communications for the off-board (dynamic) navigation processing.

The roadside units 16 are configured to obtain positions of the host vehicles 10 that are traveling along various routes. The wireless communication system 21 of the host vehicle 10 communicates with the roadside units 16 along the travel route. The roadside units 16 are positioned at various distances along different routes. Since roadside units are known in the art, the structures of the roadside units 16 will not be discussed or illustrated in detail herein. Rather, it will be apparent to those skilled in the art from this disclosure that the roadside unit can be any type of structure that can be used to carry out the present invention.

Figure 3:
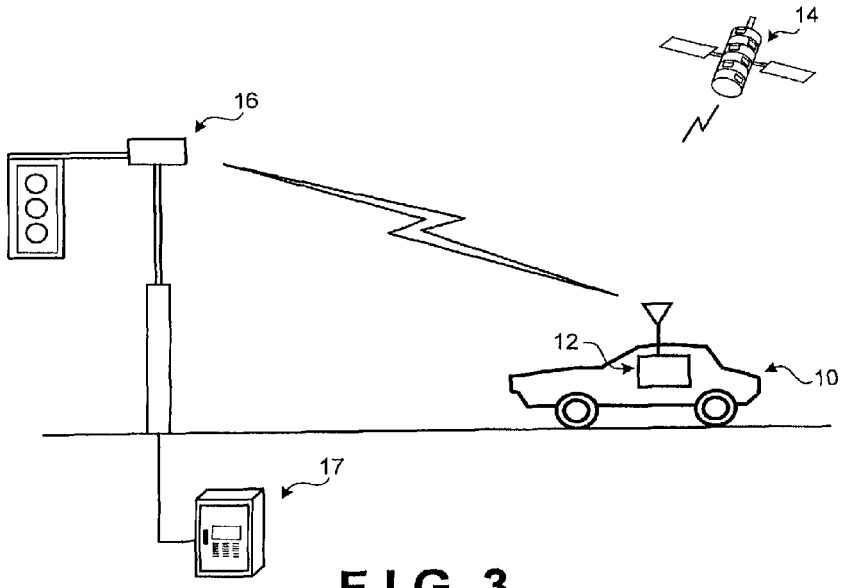
FIG. 3 is a pictorial representation of the wireless communications network showing the communications between an intersection unit and the on-board vehicle warning system via the roadside unit in the vehicle infrastructure system in accordance with the illustrated embodiment of the present invention.

As seen in FIG. 3, the wireless communications are conducted between the vehicles 10 and the roadside unit 16 that is disposed in the vicinity of the upcoming intersection. The intersection unit 17 is operatively coupled to the roadside unit 16 so that the traffic intersection information can be communicated from the intersection unit 17 to the on-board vehicle warning system 12 of the host vehicle 10 via the roadside unit 16. Moreover, the intersection unit 17 is preferably configured to periodically broadcast a signal indicative of the traffic intersection information and the basic Safety (heartbeat) message in the broadcast area via the roadside unit 16. The signal can be broadcasted in three different way, i.e., (1) event based broadcasting, (2) periodic broadcasting (e.g., every 100 msec) and (3) hybrid (event based/periodic) broadcasting. Preferably, periodic broadcasting or hybrid (event based/periodic) broadcasting is used to carry out the illustrated embodiment.

The traffic intersection information sent from the intersection unit 17 to the host vehicle 10 includes, for example, the geometric intersection description (GID) information, the signal phase and timing (SPAT) information, the GPS correction information, the road condition information, etc. The GID information is a small map that describes the intersection geometry, including intersection reference points (see FIG. 6), intersection orientation, stop bar locations for all lanes in the intersection, number of lanes per approach, lane geometry, starting point for new lanes, lane number, etc. The SPAT information contains the current signal phase and the time to phase change in the traffic light device for each lane.

Figure 5:
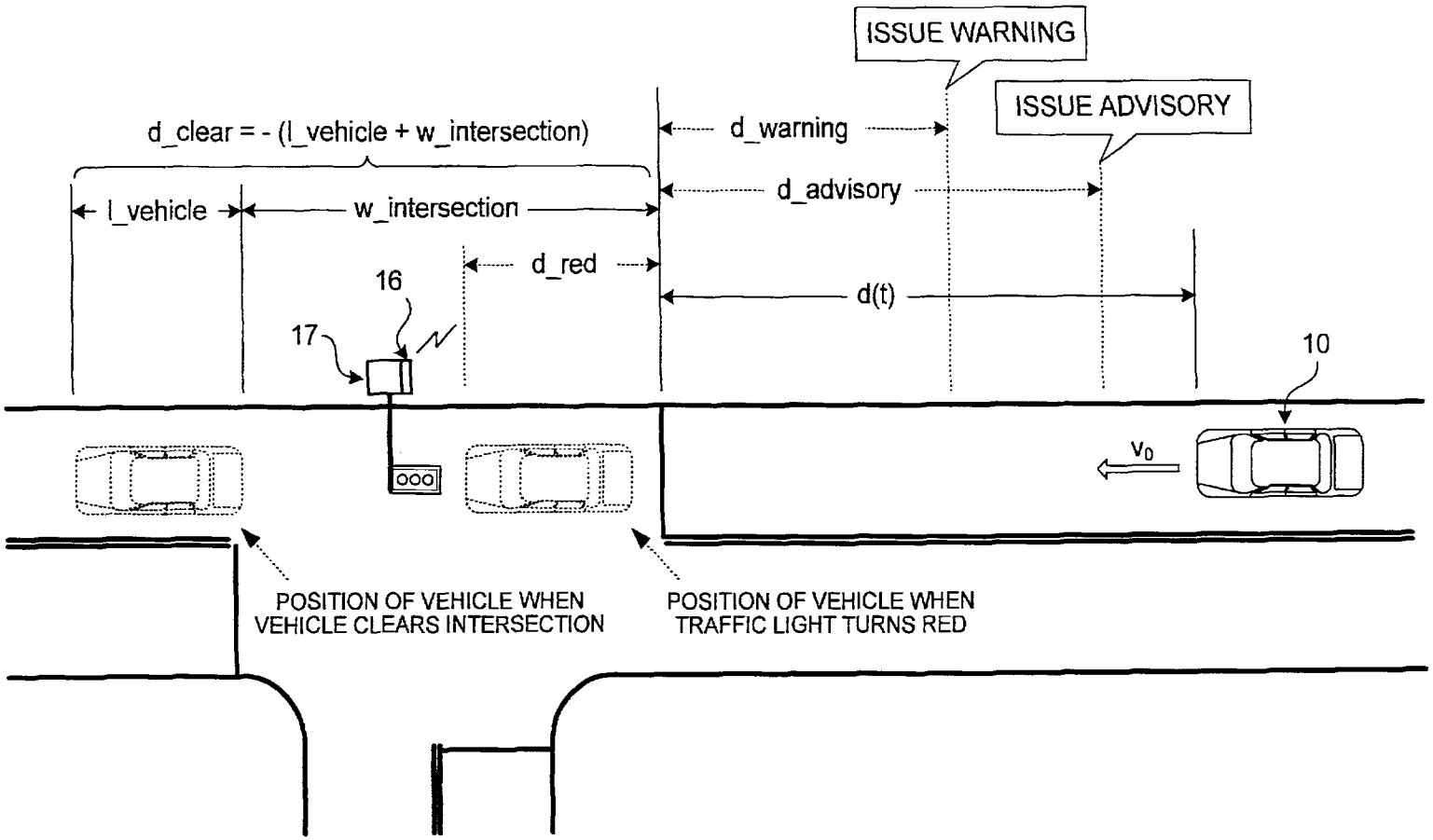
FIG. 5 is a pictorial representation for explaining timings for issuing an advisory and a warning in the on-board vehicle warning system in accordance with the illustrated embodiment of the present invention.

As shown in FIG. 5, when the host vehicle 10 approaches the upcoming intersection, the on-board vehicle warning system 12 receives the intersection information from the intersection unit 17 via the roadside unit 16. Then the control unit 20 is configured to calculate various parameters such as an advisory distance (d_advisory) (i.e., the distance to the stop bar at which the advisory is issued), a warning distance (d_warning) (i.e., the distance to the stop bar at which the warning is issued), a distance from the current position of the host vehicle 10 to the stop bar (d(t)), a width of the intersection (w_intersection), a clearance distance (d_clear) (i.e., the distance from the stop bar at which the host vehicle 10 exits from the intersection).

Calculation of Advisory Distance (d_advisory)

The advisory distance (d_advisory) is a distance to the stop bar at which the advisory is issued. The advisory is intended to give the driver of the host vehicle 10 preview information about an impending phase change. In other words, the advisory indicates that if the host vehicle 10 continues to travel at the current vehicle speed ($v_0$), the signal will be in such a phase that the host vehicle 10 will commit a signal violation before the host vehicle 10 clears the intersection. Thus, the control unit 20 is configured to issue an advisory upon the host vehicle 10 reaching the advisory distance (d_advisory) with respect to the traffic intersection (the stop bar) which requires the host vehicle 10 to decelerate at a prescribed rate in order to stop before it reaches the traffic intersection. The advisory distance (d_advisory) is calculated according to the equation (1) below.

$$d_\text{advisory}=d_\text{react}+d_\text{decel}+d_\text{margin}+d_\text{hys}+d_\text{mingap} \tag{1}$$

In the equation (1), the value "d_react" represents a reaction distance, the value "d_decel" represents a deceleration distance, the value "d_mingap" represents a minimum distance to the stop bar, the value "d_margin" represents a margin from the stop bar, the value "d_hys" represents the hysteresis. The minimum distance "d_mingap", the margin "d_margin", and the hysteresis "d_hys" are preferably set in advance to appropriate values.

The reaction distance "d_react" is a distance traveled while traveling at the current speed until the braking is first applied. The reaction distance "d_react" is calculated according to the equation (2) below.

$$d_\text{react}=v_0 \cdot t_\text{react} \tag{2}$$

In the equation (2) above, the value "$v_0$" represents the current vehicle speed (m/s) and the value "t_react" represents a reaction time. The reaction time "t_react" is preferably set in advance to an appropriate value.

The deceleration distance "d_decel" in the equation (1) is a distance traveled from the time the braking is first applied until the vehicle stops. The deceleration distance "d_decel" is calculated according to the equation (3) below.

$$\text{d_decel} = \frac{\left(\text{v_rel}+\left(\frac{\text{a_est}^2}{2\text{J_est}}\right)\right)^2}{2\text{a_est}} - \frac{\text{a_est}^3}{6\text{J_est}^2} = \frac{v_0^2}{2\text{a_est}} + \frac{\text{a_est}}{2\text{J_est}}v_0 - \frac{\text{a_est}^3}{24\text{J_est}^2} \tag{3}$$

In the equation (3), the value "$v_0$" represents the current vehicle speed (m/s), the value "a_est" represents an estimated deceleration, and the value "J_est" represents an estimated jerk. The estimated deceleration "a_est" and the estimated jerk "J_est" are preferably set in advance to appropriate values.

Calculation of Warning Distance (d_warning)

The warning distance (d_warning) is a distance to the stop bar at which the warning is issued. The warning is intended to keep the host vehicle 10 from committing the signal violation. Thus, the warning indicates that an action must be taken immediately to stop the host vehicle 10 in order to avoid the traffic signal violation. The control unit 20 is configured to issue a warning upon the host vehicle 10 reaching the warning distance (d_warning) with respect to the traffic intersection (the stop bar) which requires the host vehicle 10 to decelerate at a prescribed rate in order to stop before it reaches the traffic intersection. The warning distance (d_warning) is calculated according to the equation (4) below.

$$d_\text{warning}=d_\text{react}+d_\text{decel}+d_\text{margin}+d_\text{hys} \tag{4}$$

In the equation (4), the value "d_react" represents the reaction distance, the value "d_decel" represents the deceleration distance, the value "d_margin" represents the margin from the stop bar, and the value "d_hys" represents the hysteresis. The margin "d_margin", and the hysteresis "d_hys" are preferably set in advance to appropriate values. The reaction distance "d_react" is calculated according to the equation (2) as explained above. The deceleration distance "d_decel" is calculated according to the equation (3) as explained above.

Calculation of Width of Intersection (w_intersection)

Figure 6:
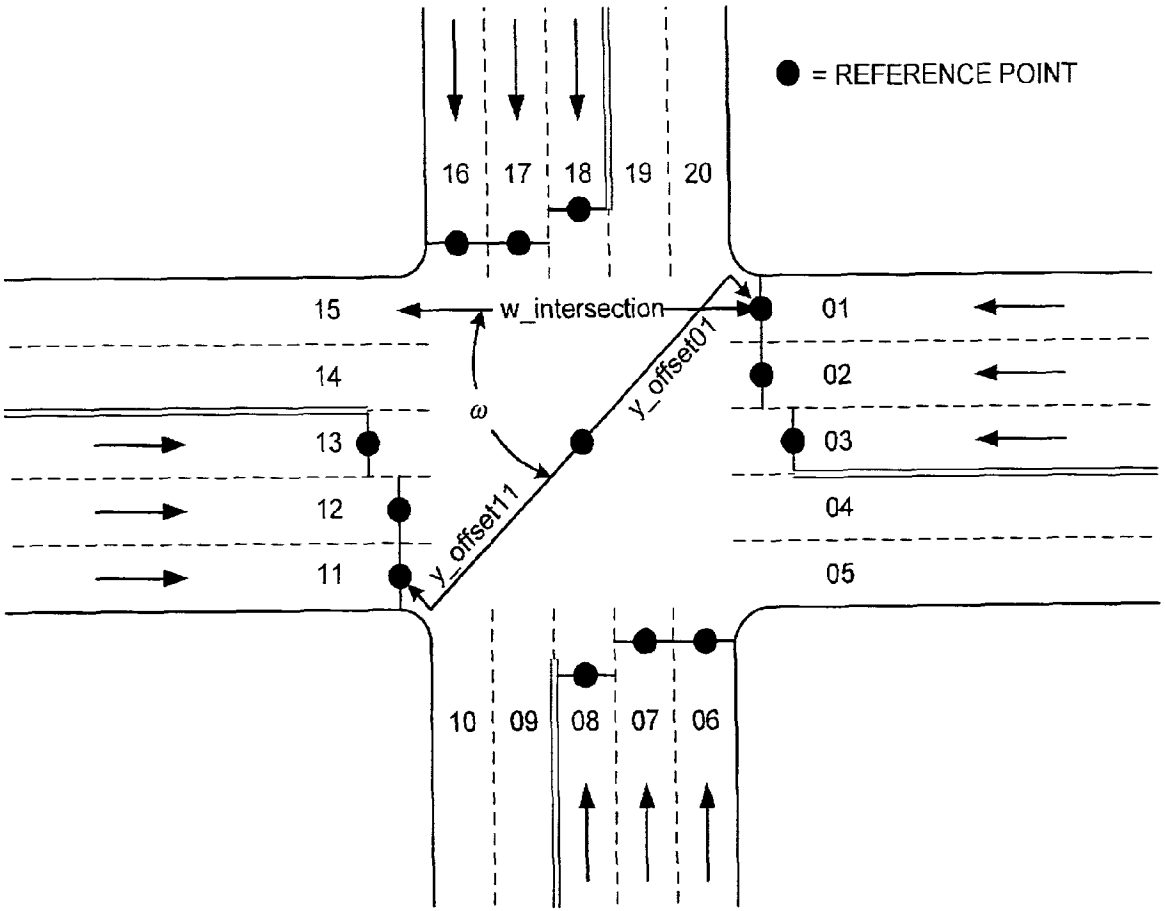
FIG. 6 is a schematic representation showing various reference points in the intersection that are contained in the geometric intersection description (GID) information received by the on-board vehicle warning system in accordance with the illustrated embodiment of the present invention.

The calculation of the width of the intersection (w_intersection) will be explained with reference to FIG. 6. The width of the intersection (w_intersection) as illustrated in FIG. 6 can be calculated based on the geometric intersection description (GID) information received from the intersection unit 17 via the roadside unit 16. More specifically, the GID information includes the information of various reference points for the intersection as shown in FIG. 6. Based on the information of the references points, the width of the intersection (w_intersection) can be calculated according to the equation (5) below.

$$w_\text{intersection}=(y_\text{offset01}+y_\text{offset11})\cos\omega \tag{5}$$

In the equation (5), the value "ω" represents the vehicle heading.

Calculation of Distance to Stop Bar (d(t))

The distance to the stop bar (d(t)) is initially calculated as an initial distance to the stop bar ($d_0$) according to the equation (6) below.

$$d_0 = (1-f)r_e\sqrt{\frac{(\theta_{vp0}-\theta sb)^2\cos^2\varphi_{sb}+(\varphi_{vp0}-\varphi_{sb})^2}{\sin^2\varphi_{sb}+(1-f)^2\cos^2\varphi_{sb}}} \tag{6}$$

In the equation (6), the value "$r_e$" is the primary parameter in the World Geodetic System—1984 (WGS84) coordination system defining the semimajor axis, which is set to 6,378,137 m. The value "f" is the primary parameter in the WGS84 coordination system defining the flattening, which is set to 1/298.257223563. The value "$\theta_{vp0}$" represents the initial vehicle longitude, the value "$\phi_{vp0}$" represents the initial vehicle latitude, the value "$\theta_{sb}$" represents the stop bar longitude and the value "$\phi_{sb}$" represents the stop bar latitude. The vehicle longitude "$\theta_{vp0}$" and the vehicle latitude "$\phi_{vp0}$" are preferably determined based on the information received in the global positioning system 23.

For the subsequent calculation, the distance to the stop bar (d(t)) is calculated by updating the initial vehicle longitude "$\theta_{vp0}$" and the initial vehicle latitude "$\phi_{vp0}$" in the equation (6) above to the current vehicle longitude "$\theta_{vs(t)}$" and the current vehicle latitude "$\phi_{vp(t)}$" as the equation (6)' below.

$$d(t) = (1-f)r_e\sqrt{\frac{(\theta_{vp(i)}-\theta sb)^2\cos^2\varphi_{sb}+(\varphi_{vp(i)}-\varphi_{sb})^2}{\sin^2\varphi_{sb}+(1-f)^2\cos^2\varphi_{sb}}} \quad (6)'$$

Alternatively, the updated distance to the stop bar (d(t)) can be calculated using the equation (7) below.

$$d(t)=d(t-1)+v_0\cdot t \quad (7)$$

Calculation of Clearance Distance (d_clear)

The clearance distance (d_clear) is a distance from the stop bar at which the host vehicle 10 completely exits from the intersection. The clearance distance (d_clear) is calculated according to the equation (8) below.

$$d_\text{clear}=-(w_\text{intersection}+l_\text{vehicle}) \quad (8)$$

In the equation (8) above, the value "l_vehicle" represents a longitudinal length of the vehicle body of the host vehicle 10. The longitudinal length "l_vehicle" is preferably measured and stored in the map database and storage section 25 in advance. Thus, the control unit 20 is configured to determine the potential traffic violation by taking into account the longitudinal length "l_vehicle" of the vehicle body of the host vehicle 10 to calculate timings at which the host vehicle 10 enters the traffic intersection and exits the traffic intersection.

In the illustrated embodiment, the control unit 20 is preferably configured to adjust the advisory/warning parameters (e.g., the minimum gap "d_mingap", the margin "d_margin" and the hysteresis "d_hys") used in the equations (1) and (4) above for determining the advisory distance (d_advisory) and the warning distance (d_warning), respectively, corresponding to the local traffic regulation that is in effect in the current location of the host vehicle 10. As mentioned above, there are two general approaches to traffic regulations pertaining to traffic signals. Some jurisdictions allow vehicles to enter intersections on a yellow light while other jurisdictions permit vehicles to enter intersections only on a green light. In the latter case, warnings and advisories are preferably issued earlier as compared to the former case. Thus, the control unit 20 is configured to adjust the advisory/warning parameters for determining the timings at which the advisory and the warning are issued (i.e., the advisory distance (d_advisory) and the warning distance (d_warning)) according to the local traffic regulation corresponding to the current location of the host vehicle 10.

For example, if the traffic regulation in effect in the current location of the host vehicle 10 permits vehicles to enter intersections only on a green light, then the control unit 20 is configured to load the advisory/warning parameters corresponding to such traffic regulation so that the advisory and/or warning is issued at relatively early timing. On the other hand, if the traffic regulation in effect in the current location of the host vehicle 10 allows vehicles to enter intersections on a yellow light, then the control unit 20 is configured to load the advisory/warning parameters corresponding to such traffic regulation so that the advisory and/or warning is issued at appropriate timing.

FIG. 7 shows a table that is used in one example for determining the advisory/warning parameters (e.g., the minimum gap "d_mingap", the margin "d_margin" and the hysteresis "d_hys") corresponding to the local traffic regulation for calculating the advisory distance (d_advisory) and the warning distance (d_warning), respectively, according to the equations (1) and (4) above. Based on the current location of the host vehicle 10, the control unit 20 is preferably configured to refer to a database stored in the map database and storage section 25 or to access an external database via wireless communication link to determine what traffic rules apply to the location in which the host vehicle 10 is currently located. From this information, the control unit 20 is configured to choose from a plurality of stored values associated with parameters that are used to modify the timing for issuing advisories and warnings. For example, the different values for the minimum gap "d_mingap", the margin "d_margin" and the hysteresis "d_hysteresis" are stored in the database according to the different traffic laws as shown in FIG. 7. If the host vehicle 10 is in a jurisdiction where entering an intersection on a yellow signal is permitted, the control unit 20 is configured to load prescribed values "$d_mingap_a$", "$d_margin_a$" and "$d_hysteresis_a$" for the minimum gap, the margin and the hysteresis, respectively, to calculate the advisory distance (d_advisory) and the warning distance (d_warning) using the equations (1) and (4). The prescribed values "$d_mingap_a$", "$d_margin_a$" and "$d_hysteresis_a$" are preferably set in advance to appropriate values. On the other hand, if the host vehicle 10 is located in a jurisdiction where entering an intersection on a yellow signal is not permitted, the control unit 20 is configured to load prescribed values "$d_mingap_b$", "$d_margin_b$" and "$d_hysteresis_b$" for the minimum gap, the margin and the hysteresis, respectively, to calculate the advisory distance (d_advisory) and the warning distance (d_warning) using the equations (1) and (4). The prescribed values "$d_mingap_b$", "$d_margin_b$" and "$d_hysteresis_b$" are preferably set in advance to appropriate values so that the advisories and warnings are issued at relatively earlier timings as compared to when the prescribed values "$d_mingap_a$", "$d_margin_a$" and "$d_hysteresis_a$" are used. If for some reason the control unit 20 is unable to determine what traffic laws apply in the current location of the host vehicle 10, the control unit 20 is preferably configured to use prescribed values "$d_mingap_c$", "$d_margin_c$" and "$d_hysteresis_c$" that are set in advance to appropriate values. Alternatively, the control unit 20 can be configured to use the prescribed values "$d_mingap_b$", "$d_margin_b$" and "$d_hysteresis_b$" as the most conservative values if the control unit 20 is unable to determine what traffic laws apply in the current location of the host vehicle 10.

Accordingly, with the on-board vehicle warning system 12 of the illustrated embodiment, the timings at which the advisories and warnings are issued (e.g., the advisory distance (d_advisory) and the warning distance (d_warning)) are appropriately adjusted according to the traffic regulation that is in effect in the current location of the host vehicle 10.

Referring back to FIG. 5, when the phase of the traffic light in front of the host vehicle 10 is in green, no advisory or warning is issued from the on-board vehicle warning system 12. When the phase of the traffic light is in yellow, the control unit 20 is configured to determine a potential traffic violation by the host vehicle 10 according to the local traffic regulation. More specifically, the control unit 20 is configured to calculate the distance from the stop bar when the signal turns red (d_red) based on the SPAT information received from the intersection unit 17 and the vehicle travel information such as the current speed ($v_o$) of the host vehicle 10. The distance from the stop bar when the signal phase changes to red (d_red) can be calculated according to the equation (9) below.

$$d_\text{red}=d(t)-v_0\cdot t_{y\to r} \quad (9)$$

In the equation (9), the value "$t_{y\to r}$" represents the amount of time left before the signal changes to red, which is determined based on the SPAT information received from the intersection unit 17 via the roadside unit 16. In the equation (9), the distance from the stop bar (d_red) is calculated so that the value becomes smaller (negative value) as the position of the host vehicle 10 advances further away from the intersection.

When it is determined that the host vehicle 10 will be able to clear the intersection before the signal phase changes to red if the host vehicle 10 continues to travel at the current speed ($v_0$) (i.e., the distance from the stop bar when the signal turns red (d_red) is beyond the clearance distance (d_clear)), then the control unit 20 does not issue an advisory or a warning. However, when it is determined that the host vehicle 10 will still be traveling within the intersection when the signal phase changes to red if the host vehicle 10 continues to travel at the current speed ($v_0$) (i.e., the distance from the stop bar when the signal turns red (d_red) is not beyond the clearance distance (d_clear)), the host vehicle 10 is required to stop prior to the intersection in order to avoid committing a traffic light violation. Therefore, in such case, the control unit 20 determines whether the host vehicle 10 is taking action to stop or decelerate before the intersection. If the control unit 20 determines that the host vehicle 10 is not taking action to decelerate or stop before the intersection, then the control unit 20 issues the advisory at appropriate timing. More specifically, the advisory is issued at timing when the host vehicle 10 is within the distance (d_advisory) in which it would require the driver to brake at some predetermined level of deceleration in order to come to a stop at the stop bar prior to the intersection.

When the phase of the traffic light is in red in the example shown in FIG. 5, the host vehicle 10 is required to stop at the stop bar in order to avoid committing a traffic light violation. Therefore, the control unit 20 determines whether the host vehicle 10 is stopping. If the control unit 20 determines that the host vehicle 10 is not taking action to stop before the intersection, then the control unit 20 issues the warning at appropriate timing. The warning is issued at timing when the host vehicle 10 is within the distance (d_warning) in which it would require the driver to brake at some predetermined level of deceleration in order to come to a stop at the stop bar prior to the intersection.

The example as shown in FIG. 5 is directed to a situation where the host vehicle 10 is located in the jurisdiction in which no offence has been committed as long as the light is yellow when the vehicle enters the intersection. However, as the host vehicle 10 travels across different jurisdictions, the traffic regulation that defines the traffic light violations changes. Thus, the control unit 20 is configured to adjust the advisory/warning parameters for determining the advisory distance (d_advisory) and the warning distance (d_warning) according to the local traffic regulation that is in effect in the current location of the host vehicle 10.

Moreover, the control unit 20 can also be configured to adjust calculation process for determining the potential traffic violation by the host vehicle 10 in addition to adjusting the advisory/warning parameters. For example, if the local traffic regulation defines no offence has been committed as long as the light is yellow when the vehicle enters the intersection, then the control unit 20 can be configured to adjust the control flow for determining the potential traffic violation and for issuing the driver notification so that an advisory and/or a warning is issued only when the control unit 20 determines the host vehicle 10 will enter the intersection after the light turns red based on the intersection information and the vehicle travel information. In other words, it may not be necessary to determine whether the host vehicle 10 will be able to clear the intersection by the time the signal turns red since no offence will be committed in such jurisdiction as long as the light is yellow when the vehicle enters the intersection. On the other hand, if the traffic regulation in effect in the current location of the host vehicle 10 defines running a yellow light is an offence, then the control unit 20 is configured to adjust the parameters and/or the control flow for determining the potential traffic violation and for issuing the driver notification so that an advisory and/or a warning is issued to the driver when the control unit 20 determines that the host vehicle 10 will enter the intersection after the light turns yellow based on the intersection information and the vehicle travel information.

Thus, the on-board vehicle warning system 12 according to the illustrated embodiment is configured and arranged to determine the potential traffic violation and to issue the advisory and/or the warning at appropriate timings according to the local traffic regulation that is in effect in the current location of the host vehicle 10.

Figure 8:
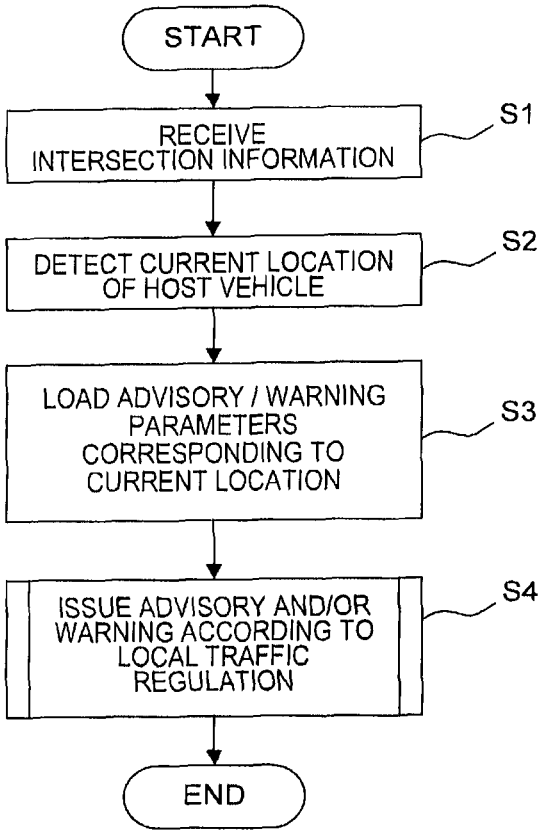
FIG. 8 is a flowchart showing a main control flow executed by the on-board vehicle warning system in accordance with the illustrated embodiment of the present invention.

Referring now to a flowchart of FIG. 8, the main control executed by the control unit 20 of the on-board vehicle warning system 12 for alerting the driver of the host vehicle 10 of the potential traffic light violation will be explained. The control flow illustrated in FIG. 8 is executed when the host vehicle 10 enters within the broadcast range of the roadside unit 16 coupled to the intersection unit 17 as the host vehicle 10 approaches the upcoming intersection.

In step S1, the wireless communication system 21 of the on-board vehicle warning system receives the intersection information relating to the upcoming intersection from the intersection unit 17 via the roadside unit 16.

In step S2, the control unit 20 is configured to detect the current location of the host vehicle 10 based on the signals received from the global positioning system 23.

In step S3, the control unit 20 is configured to load advisory/warning parameters corresponding to the local traffic regulation that is in effect in the current location of the host vehicle 10 detected in step S2. More specifically, as mentioned above, the control unit 20 is preferably configured to load the minimum gap "d_mingap", the margin "d_margin" and hysteresis "d_hys" for calculating the advisory distance (d_advisory) and the warning distance (d_warning) corresponding to the local traffic regulation from the table such as one shown in FIG. 7 stored in the map database and storage section 25 or the external database.

In step S4, the control unit 20 is configured to execute a control for determining a potential traffic light violation and for issuing the driver notification (advisories and/or warnings) using the advisory/warning parameters loaded in step S3.

Referring now to a flowchart of FIG. 9, one example of the control processing executed in step S4 of FIG. 8 for determining the potential traffic violation and issuing the advisory and/or the warning will be explained in accordance with the illustrated embodiment. In this example, it is assumed that the host vehicle 10 is located in the jurisdiction in which the traffic regulation defines that an offence occurs if the light turns red at any time before the vehicle clears the intersection.

Figure 9:
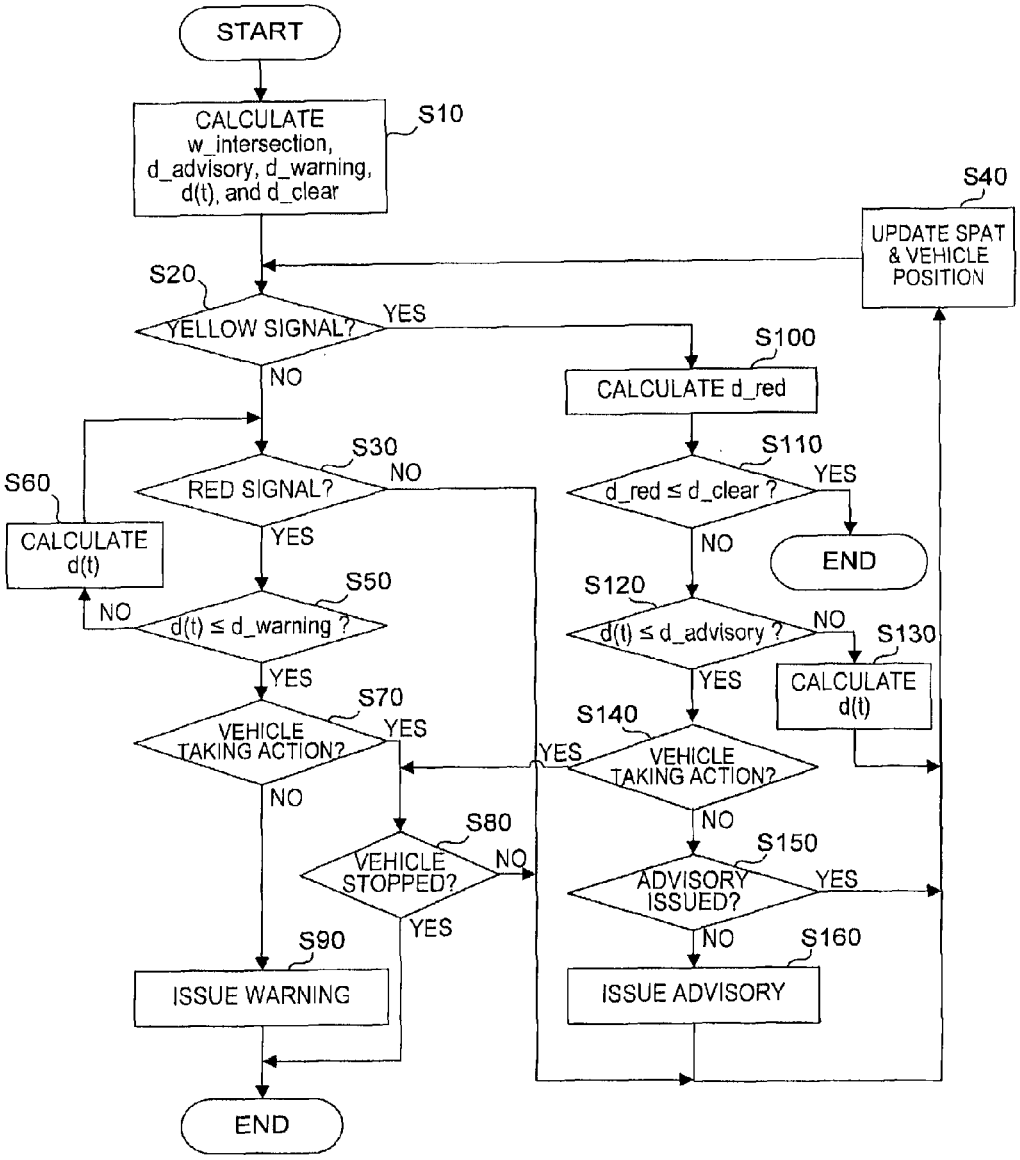
FIG. 9 is a flowchart showing a control flow executed by the on-board vehicle warning system for issuing the advisory and/or the warning in accordance with the illustrated embodiment of the present invention when the vehicle is located in the jurisdiction in which an offence occurs if the light turns red at any time before the vehicle clears the intersection.

In step S10 of FIG. 9, the control unit 20 is configured to calculate values corresponding to the width of the intersection (w_intersection), the advisory distance (d_advisory), the warning distance (d_warning), the distance to the stop bar (d(t)) and the clearance distance (d_clear) as explained above with reference to FIG. 5.

In step S20, the control unit 20 is configured to determine whether the current phase of the traffic light is in yellow based on the intersection information received from the intersection unit 17 via the roadside unit 16. If the current phase of the traffic light is in yellow (Yes in step S20), then the control unit 20 proceeds to step S100. On the other hand, if the current phase of the traffic light is not in yellow (No in step S20), then the control unit 20 proceeds to step S30.

In step S30, the control unit 20 is configured to determine whether the current phase of the traffic light is in red based on the intersection information received from the intersection unit 17 via the roadside unit 16. If the current phase of the traffic light is in red (Yes in step S30), then the control unit 20 proceeds to step S50. On the other hand, if the current phase of the traffic light is not in red (No in step S30), then the control unit 20 proceeds to step S40.

In step S40, the control unit 20 is configured to update the SPAT information based on the updated intersection information received from the intersection unit 17 via the roadside unit 16. Also, the control unit 20 is configured to update the vehicle travel information based on the current vehicle travel condition detected by the vehicle information detecting section. Then, the control unit 20 returns to step S20.

In step S50, the control unit 20 is configured to determine whether the current distance between the host vehicle 10 and the stop bar (d(t)) is equal to or smaller than the warning distance (d_warning). If the distance to the stop bar (d(t)) is larger than the warning distance (d_warning) (No in step S50), then the control unit 20 proceeds to step S60.

In step S60, the control unit 20 is configured to recalculate (update) the distance to the stop bar (d(t)), and then to return to step S30.

On the other hand, if the distance to the stop bar (d(t)) is equal to or smaller than the warning distance (d_warning) (Yes in step S50), then the control unit 20 proceeds to step S70.

In step S70, the control unit 20 is configured to determine whether the host vehicle 10 is taking action to decelerate or stop before the intersection based on the vehicle travel information. Whether the host vehicle 10 is taking action or not is preferably determined by monitoring both the detection signals from the throttle position and the brake lamp switch. If the throttle position is reduced or if the brake lamp switch is activated, the control unit 20 interprets these inputs as the driver of the host vehicle 10 at least being aware of the traffic situation. If the control unit 20 determines that the host vehicle 10 is taking action to decelerate or stop before the intersection (Yes in step S70), then the control unit 20 proceeds to step S80.

In step S80, the control unit 20 is configured to determine whether the host vehicle 10 has stopped. If the control unit 20 determines that the host vehicle 10 has stopped (Yes in step S80), the control unit 20 ends the current control cycle. On the other hand, if the control unit 20 determines that the host vehicle 10 has not stopped (NO in step S80), then the control unit 20 proceeds to step S40 where the SPAT information and the vehicle travel information are updated before the control processing returns to step S20.

On the other hand, if the control unit 20 determines that the host vehicle 10 is not taking any action to decelerate or stop before the intersection (No in step S70), then the control unit 20 proceeds to step S90.

In step S90, the control unit 20 is configured to issue a warning to the driver of the host vehicle 10. Then, the control unit 20 ends the current control cycle.

Referring back to step S20, if the control unit 20 determines that the current phase of the signal is in yellow (Yes in step S20), the control unit 20 proceeds to step S100.

In step S100, the control unit 20 is configured to calculate a distance from the stop bar when the signal phase changes to red (d_red) as explained above with reference to FIG. 5.

In step S110, the control unit 20 is configured to determine whether the distance from the stop bar when the signal phase changes to red (d_red) is equal to or smaller than the clearance distance (d_clear). If the control unit 20 determines that the distance from the stop bar when the signal phase changes to red (d_red) is equal to or smaller than the clearance distance (d_clear) (Yes in step S110), the host vehicle 10 is able to clear the intersection before the signal turns red. Therefore, the control unit 20 ends the control processing of the current cycle. On the other hand, if the control unit 20 determines that the distance from the stop bar when the signal phase changes to red (d_red) is larger than the clearance distance (d_clear) (No in step S110), the host vehicle 10 will not be able to exit the intersection before the signal turns red, and thus, the control unit 20 proceeds to step S120.

In step S120, the control unit 20 is configured to determine whether the distance to the stop bar (d(t)) is equal to or smaller than the advisory distance (d_advisory). If the control unit 20 determines that the distance to the stop bar (d(t)) is larger than the advisory distance (d_advisory) (No in step S120), then the control unit 20 proceeds to step S130 to calculate the updated distance to the stop bar (d(t)), and to step S40 where the SPAT information and the vehicle travel information are updated before the control processing returns to step S20.

On the other hand, if the control unit 20 determines that the distance to the stop bar (d(t)) is equal to or smaller the advisory distance (d_advisory) (Yes in step S120), then the control unit 20 proceeds to step S140.

In step S140, the control unit 20 is configured to determine whether the host vehicle 10 is taking action to decelerate or stop before the intersection based on the vehicle travel information. Whether the host vehicle 10 is taking action or not is preferably determined by monitoring both the detection signals from the throttle position and the brake lamp switch. If the throttle position is reduced or if the brake lamp switch is activated, the control unit 20 interprets these inputs as the driver of the host vehicle 10 at least being aware of the traffic situation. If the control unit 20 determines that the host vehicle 10 is taking action to decelerate or stop before the intersection, then the control unit proceeds to step S80. On the other hand, if the control unit 20 determines that the host vehicle 10 is not taking any action to decelerate or stop before the intersection, then the control unit 20 proceeds to step S150.

In step S150, the control unit 20 is configured to check if an advisory has already been issued previously in the current control cycle. If the advisory has already been issued (Yes in step S150), then the control unit 20 proceeds to step S40 where the SPAT information and the vehicle travel information are updated before the control processing returns to step S20. On the other hand, if the advisory has not been issued yet (No in step S150), then the control unit 20 proceeds to step S160.

In step S160, the control unit 20 is configured to issue an advisory to the driver. Then, the control unit 20 proceeds to step S40 where the SPAT information and the vehicle travel information are updated before the control processing returns to step S20.

The control flow illustrated in FIG. 9 is explained as being executed by the control unit 20 in step S4 of FIG. 8 when the host vehicle 10 is located in the jurisdiction where a traffic light violation occurs if the light turns red at any time before the host vehicle 10 clears the intersection. As the host vehicle 10 travels across different jurisdictions, the control unit 20 is configured to adjust the advisory/warning parameters (e.g., load the new parameters) corresponding to the current jurisdiction. In addition, the control unit 20 can be configured to adjust the control flow for determining the potential traffic violation and producing the driver notification in step S4 of FIG. 8 to be commensurate with the local traffic regulation that is in effect in the current location of the host vehicle 10. For example, the control flow illustrated in FIG. 9 may be used in the jurisdiction where no offence has been committed as long as the light is yellow when the vehicle enters the intersection by merely adjusting the parameter for determining the potential traffic violation and producing the driver notification (e.g., setting the clearance distance (d_clear) to a smaller value). Moreover, the control unit 20 can be configured to modify the control flow illustrated in FIG. 9 to adapt the calculations for determining the potential traffic violation to the local traffic regulation.

In the illustrated embodiment explained above, the control unit 20 is configured to issue the driver notification (an advisory and/or a warning) when the control unit 20 detects the potential traffic violation by the host vehicle 10. In addition, the control unit 20 can be configured to apply a preemptive vehicle control for decelerating the host vehicle 10, such as controlling the brake system to automatically brake the host vehicle 10, in order to prevent the host vehicle 10 from committing a traffic violation.

GENERAL INTERPRETATION OF TERMS

In understanding the scope of the present invention, the term "configured" as used herein to describe a section, section or part of a device includes hardware and/or software that is constructed and/or programmed to carry out the desired function. In understanding the scope of the present invention, the term "comprising" and its derivatives, as used herein, are intended to be open ended terms that specify the presence of the stated features, elements, sections, groups, integers, and/or steps, but do not exclude the presence of other unstated features, elements, sections, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. As used herein to describe the present invention, the following directional terms "forward, rearward, above, downward, vertical, horizontal, below and transverse" as well as any other similar directional terms refer to those directions of a vehicle equipped with the present invention. Accordingly, these terms, as utilized to describe the present invention should be interpreted relative to a vehicle equipped with the present invention as used in the normal riding position.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. An on-board vehicle warning system comprising:

a location detecting section configured to detect a geographic location of a host vehicle equipped with the on-board vehicle warning system, and a geographic location of a forthcoming intersection;

a regulation retrieving section configured to retrieve a jurisdiction based on the geographic location of the forthcoming intersection, the jurisdiction including local intersection regulation information containing information pertaining to a vehicle position with respect to an intersection boundary at the time of a particular phase transition of a traffic light device;

an incoming message receiving section configured to receive intersection status information of the forthcoming intersection containing a geographic location of a boundary of the forthcoming intersection and phase information including a current phase and a time to the particular phase transition of a traffic light device of the forthcoming intersection; and a potential violation alerting section configured to estimate a future position at which the host vehicle will be with respect to the boundary of the forthcoming intersection at the time that the particular phase transition is going to occur to determine a potential violation.

2. The on-board vehicle warning system according to claim 1, wherein:

the potential violation alerting section is further configured to determine when the estimated future position will be impermissible based on the local intersection regulation information, and provide a warning when the estimated future position is determined to be impermissible.

3. The on-board vehicle warning system according to claim 2, wherein:

the potential violation alerting section is further configured to estimate a required stopping distance and a reaction distance, determine a first warning distance from the boundary of the forthcoming intersection based on the reaction distance and the required stopping distance when the estimated future position is determined to be impermissible, and provide a first warning notification when the host vehicle reaches the first warning distance.

4. The on-board vehicle warning system as recited in claim 1, wherein the potential violation alerting section is further configured to determine whether the host vehicle is taking an action to avoid the potential violation based on host vehicle travel information.

5. The on-board vehicle warning system as recited in claim 4, wherein the potential violation alerting section is configured to produce a driver notification when the potential violation alerting section determines that the host vehicle is required to stop prior to the forthcoming intersection in order to avoid the potential violation and that the host vehicle is not taking the action to stop to avoid the potential violation.

6. The on-board vehicle warning system as recited in claim 5, wherein the potential violation alerting section is configured to issue a warning as the driver notification when the phase information of the traffic light device indicates that the current phase of the traffic light device is red and when the potential violation alerting section determines that the host vehicle is not stopping upon the host vehicle reaching a position with respect to the forthcoming intersection which requires the host vehicle to decelerate at a prescribed rate in order to stop the host vehicle before the host vehicle reaches the forthcoming intersection.

7. The on-board vehicle warning system as recited in claim 5, wherein the potential violation alerting section is configured to issue an advisory as the driver notification when the phase information of the traffic light device indicates an impending phase change and when the potential violation alerting section determines that the host vehicle will commit a violation under the local intersection regulation information if the host vehicle continues to travel at a current speed.

8. The on-board vehicle warning system as recited in claim 7, wherein the potential violation alerting section is configured to issue the advisory upon the host vehicle reaching a position with respect to the forthcoming intersection which requires the host vehicle to decelerate at a prescribed rate in order to stop the host vehicle before the host vehicle reaches the forthcoming intersection.

9. The on-board vehicle warning system as recited in claim 1, wherein the intersection status information includes a geographic location of an entering boundary and a geographic location of an exiting boundary of the forthcoming intersection.

10. The on-board vehicle warning system as recited in claim 9, wherein the potential violation alerting section is further configured to determine a width of the forthcoming intersection between the entering boundary and the exiting boundary, and determine the potential violation based on the width of the forthcoming intersection and a longitudinal length of a vehicle body of the host vehicle.

11. A vehicle driver warning method comprising:

detecting a geographic location of a host vehicle, and a geographic location of a forthcoming intersection;

retrieving a jurisdiction including local intersection regulation information containing information pertaining to a vehicle position with respect to an intersection boundary at the time of a particular phase transition of a traffic light device at any traffic intersection governed by the jurisdiction;

receiving intersection status information of the forthcoming intersection containing a geographic location of a boundary of the forthcoming intersection and phase information including a current phase and a time to the particular phase transition of a traffic light device that exists at the forthcoming intersection; and estimating a future position at which the host vehicle will be with respect to the boundary of the forthcoming intersection at the time that the particular phase transition is going to occur to determine whether a warning of a potential violation should be provided.

12. The method as recited in claim 11, further comprising determining when the estimated future position will be impermissible based on the local intersection regulation information; and providing a warning when the estimated future position is determined to be impermissible.

13. The method as recited in claim 11, further comprising estimating a required stopping distance and a reaction distance;

determining a first warning distance from the boundary of the forthcoming intersection based on the reaction distance and the required stopping distance when the estimated future position is determined to be impermissible based on the local intersection regulation information; and providing a first warning notification when the host vehicle reaches the first warning distance.

14. The method as recited in claim 11, further comprising determining whether the host vehicle is taking an action to avoid the potential violation based on host vehicle travel information.

15. The method as recited in claim 14, further comprising determining that the host vehicle is not taking the action to stop to avoid the potential violation; and producing a driver notification.

16. The method as recited in claim 15, wherein the producing the driver notification includes issuing a warning as the driver notification when the phase information of the traffic light device indicates that the current phase of the traffic light device is red and the determining determines that the host vehicle is not stopping upon the host vehicle reaching a position with respect to the traffic intersection which requires the host vehicle to decelerate at a prescribed rate in order to stop the host vehicle before the host vehicle reaches the traffic intersection.

17. The method as recited in claim 15, wherein the producing of the driver notification issues an advisory as the driver notification when the phase information of the traffic light device indicates an impending phase change and when the determining determines that the host vehicle is not taking the action to avoid committing a violation under the local traffic intersection regulation if the host vehicle continues to travel at a current speed.

18. The method as recited in claim 17, wherein the producing of the driver notification issues the advisory upon the host vehicle reaching a position with respect to the traffic intersection which requires the host vehicle to decelerate at a prescribed rate in order to stop the host vehicle before the host vehicle reaches the traffic intersection.

19. The method as recited in claim 11, further comprising receiving a geographic location of an entering boundary and a geographic location of an exiting boundary of the forthcoming intersection.

20. The method as recited in claim 19, further comprising determining a width of the forthcoming intersection between the entering boundary and exiting boundary of the forthcoming intersection; and determining the potential violation based on the width of the forthcoming intersection and a longitudinal length of a vehicle body of the host vehicle.

* * * * *